US006739470B2

(12) United States Patent
Yawata

(10) Patent No.: US 6,739,470 B2
(45) Date of Patent: May 25, 2004

(54) CONTAINER

(75) Inventor: Masaya Yawata, Shiga (JP)

(73) Assignees: Sadao Yawata, Shiga (JP); Masaki Kato, Shiga (JP)

( * ) Notice: Subject to any disclaimer, the term of this patent is extended or adjusted under 35 U.S.C. 154(b) by 0 days.

(21) Appl. No.: 09/959,532

(22) PCT Filed: Feb. 28, 2001

(86) PCT No.: PCT/JP01/01540

§ 371 (c)(1),
(2), (4) Date: Oct. 29, 2001

(87) PCT Pub. No.: WO01/64534

PCT Pub. Date: Jul. 9, 2001

(65) Prior Publication Data

US 2002/0158074 A1 Oct. 31, 2002

(30) Foreign Application Priority Data

Feb. 29, 2000 (JP) ..... 2000-104147

(51) Int. Cl.[7] ..... B65D 25/20

(52) U.S. Cl. ..... 220/62.12; 220/62.22; 220/721; 220/DIG. 9

(58) Field of Search ..... 220/720, 721, 220/62.12, 62.22, DIG. 9, 592.2, 592.17, 903; 229/403

(56) References Cited

U.S. PATENT DOCUMENTS

| | | | | |
|---|---|---|---|---|
| 2,100,895 A | * | 11/1937 | Austin | 165/134.1 |
| 5,469,983 A | * | 11/1995 | Yawata | 220/739 |
| 5,950,917 A | * | 9/1999 | Smith | 220/903 |
| 6,364,149 B1 | * | 4/2002 | Smith | 220/592.2 |

FOREIGN PATENT DOCUMENTS

| | | |
|---|---|---|
| JP | 1-51451 | * 11/1990 |
| JP | 2-37331 | * 12/1991 |
| JP | 7-40961 | * 2/1995 |

* cited by examiner

*Primary Examiner*—Nathan J. Newhouse
*Assistant Examiner*—Joseph C. Merek
(74) *Attorney, Agent, or Firm*—Fitch, Even, Tabin & Flannery

(57) ABSTRACT

An object of the present invention is to provide an insulated container which provides a high level of safety, which can be manufactured at a low cost, and which is aesthetically attractive and appealing to enjoy a variety of changes.

7 Claims, 4 Drawing Sheets

CONTAINER

This is the U.S. National Phase of PCT/JP01/01540, filed Feb. 28, 2001, which was not filed in the English language.

FIELD OF THE INVENTION

The present invention relates to an insulated container particularly adapted to contain extremely hot water to make coffee, noodles, soup, or the like.

BACKGROUND OF THE INVENTION

Conventionally, as shown in FIG. 4(*a*), a heat insulated container having a laminated body on the outer surface of the body portion of the container disclosed in the published Japanese Patent Publication No. 07-40961 has been known as an insulated container of this type.

The laminated body B of this container is formed by bonding two types of base materials 21 and 22 which differ in beat shrinkage percentage at bonded portions 23, 24, 25, 26, 27, 28 and 29 spaced apart from each other. The laminated body B is fixed to or attached to an outer surface of the trunk portion of the thin-walled container 20 with the base material having a higher heat shrinkage percentage placed inward. Thus, the insulated container is formed. When hot water or the like is poured into the container 20, heat is conducted to the laminated body B. At the result, the base material having a higher shrinkage percentage thereby shrinks, and the base material having a lower shrinkage percentage is raised from the base material having a higher shrinkage percentage, thus forming a tunnel-like structure B'. Since space in the tunnel-like structure serves as heat insulating layer, the person can hold the container by grasping this tunnel-like structure with the hand.

However, since the appearance of the tunnel-like structure is monotonous and is lack of aesthetic elements, it has been desired to improve the container for variety.

Accordingly, it is an object of the present invention to provide an insulated container which is aesthetically attractive and appealing to enjoy a variety of changes and which can be manufactured at a low cost.

DISCLOSURE OF THE INVENTION

In order to achieve the above object, following structure is adopted to a container. A heat insulated container of the present invention comprises a thin-walled container and a laminated body. The laminated body is formed by bonding base materials having different heat shrinkage percentages at a plurality of bonded portions. At least one of the bonded portions has a substantially I-shaped cut line. The laminated body is so attached to the outer surface of the thin-walled container that the base material having a higher heat shrinkage percentage is placed inward so as to thermally shrink the inward-placed base material.

When hot water or the like is poured into the insulated container of the present invention, heat is conducted to the laminated body through the outer surface of the thin-walled container, and thereby a tunnel-like structure is formed as in the same manner as those of the conventional insulated container. However, there is a big difference between the container of the present invention and conventional containers. In the present invention, the tunnel-like structure is formed while the laminated body is opened by the substantially I-shaped cut line as if French doors are opened, and the surface of the thin-walled container can be seen from an opening of the laminated body.

Unlike conventional heat insulated containers, changes of the outward appearance of the laminated body can be appreciated and the shape of the laminated body is full of variety. Thus, the container of the present invention is further aesthetically improved. In addition, the opened tunnel-like structure can be grasped with the hand in the same manner as the conventional containers, so that heat insulating property of the container is not impaired.

BRIEF DESCRIPTION OF THE DRAWING

FIG. 1(*b*) is a plan view of a laminated body; and

FIG. 1(*c*) is a sectional view of the laminated body.

FIG. 2(*b*) is a perspective view of another embodiment of the present invention, showing the state before the application of heat.

FIG. 4(*b*) is a plan view of a conventional laminated body.

DESCRIPTION OF THE PREFERRED EMBODIMENTS

Embodiments of the heat insulated container according to the present invention will now be described in detail with reference to the accompanying drawings.

Figure 1A:
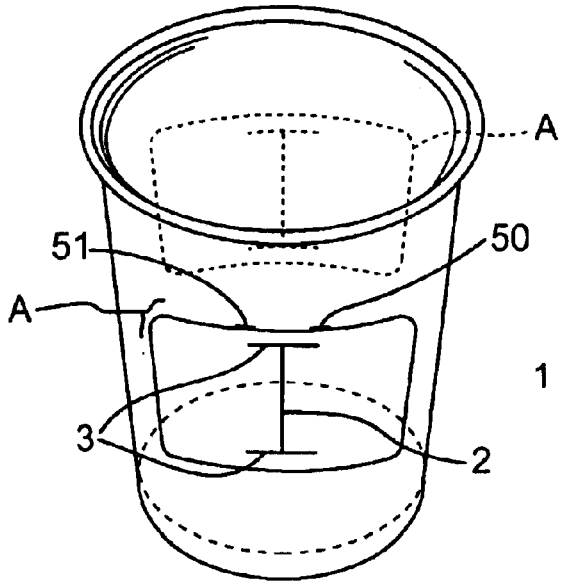
FIG. 1(*a*) is a perspective view of an embodiment of a heat insulated container of the present invention, showing the state of the container before the application of heat.
Figure 1B:
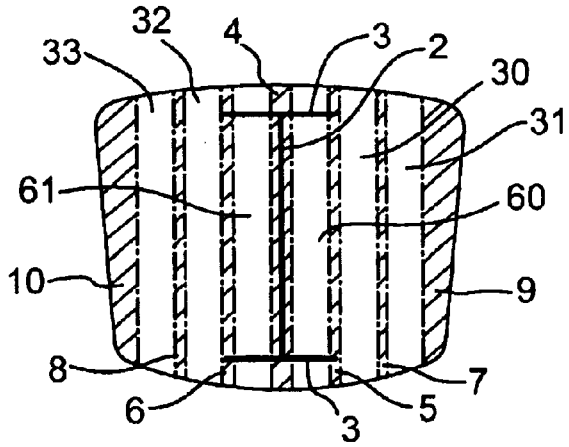
Figure 1C:
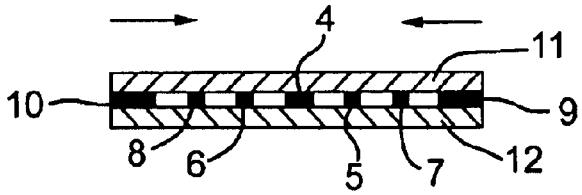

As shown in FIGS. 1(*a*) to 5(*c*), a heat insulated container of the present invention comprises: a thin-walled container composed of a trunk portion having a rim providing an open top and a closed bottom; and substantially-rectangular laminated bodies A, wherein the laminated bodies A are so attached to the outer surface of the container 1 that they face each other.

Figure 2A:
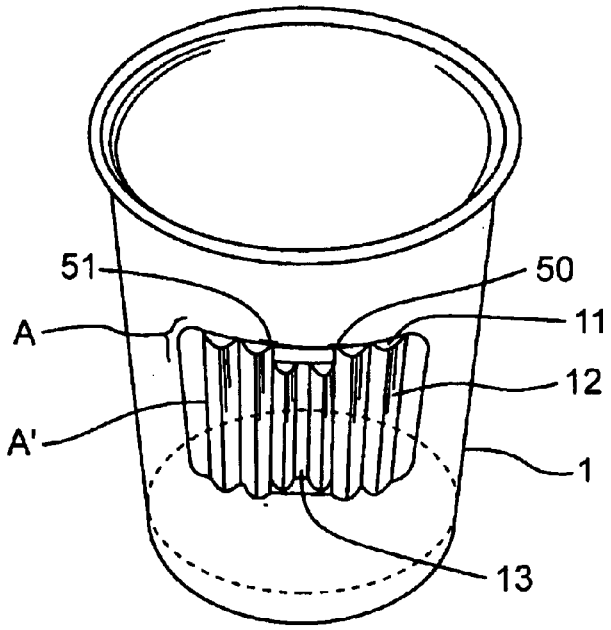
FIG. 2(*a*) is a perspective view of the container of the present invention, showing the state of the container after the application of heat.
Figure 2B:
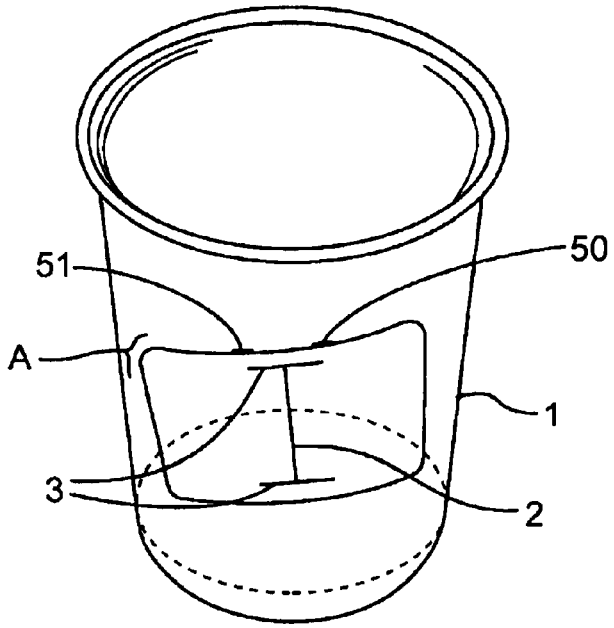

As shown in FIG. 1(*c*) and FIG. 2(*a*), the laminated body A comprises two base materials. The one is 25 $\mu$m-thick heat-shrinkable film 11 made of uniaxially-oriented polyethylene film which shrinks in the direction of the arrow, and the other is a mount 12 made of bond paper having a basis weight of 64 g/m$^2$.

The two base materials are bonded together with a strip of heat-resistant adhesion applied to the laminated body A at bonded portions 9 and 10 on both ends of the laminated body, a wide bonded portion 4 in the center, and narrow bonded portions 5, 7, 6, and 8 which are on the right and left sides of the portion 4 and spaced apart with about 5 to 6-mm pitch.

A cut line 2 which separates the wide bonded portion 4 into left and right sides is provided from top to bottom of the wide bonded portion 4 of the laminated body A except top and bottom edge portions, and cut lines 3 are provided vertically to both ends of the cut line 2 and extend close to the narrow bonded portions 5 and 6 adjacent to the portion 4. These cut lines are shaped like a letter "I".

As shown in FIG. 1(*a*), the laminated body A is attached to the outer surface of the thin-walled container 1 along the generatrix of the container 1 in such a manner that the heat shrinkable film 11 having a higher heat shrinkage percentage is placed inward and the mount 12 having a lower heat shrinkage percentage is placed outward. In this case, the laminated body A is attached to the thin-walled container 1 with heat-resistant adhesive applied to two adhesive portions 50 and 51 which are about 3 mm-wide strip-like portions extending from top to bottom of the laminated body A. In this embodiment, the two adhesive portions 50 and 51 of each of two laminated bodies A are provided to the back of the narrow bonded portions 5 and 6 which are adjacent to the substantially I-shaped cut line 2 of the laminated body A.

When hot beverage or the like is poured into the thus-structured heat insulated container of the present invention, heat is conducted to the laminated body A through the trunk portion of the thin-walled container 1 and thereby heat-shrinkable film 11 starts to shrink.

The right side of the laminated body A from the wide bonded portion 4 changes as follows. Non-bonded portions 30 and 31 which are provided on the right side of the laminated body from the narrow bonded portion 5 slides to the narrow bonded portion 5 while two tunnel-like structures are being formed.

On the other hand, a non-bonded portion 60, which is surrounded by the narrow bonded portion 5 and cut lines 2 and 3, slides from the cut line 2 to the bonded portion 5. Thus, one tunnel-like structure is formed.

The left side of the laminated body A from the wide bonded portion 4 changes in the same manner as the right side, and three tunnel-like structure are formed. As a result, the laminated portion 60 surrounded by cut lines 2 and 3 and the narrow bonded portion 5 and a laminated portion 61 surrounded by cut lines 2 and 3 and the narrow bonded portion 6 slide from the cut line 2 to the right and left sides, respectively, as if French doors are opened. Thus, tunnel-like structures A' are formed, and a window 13 is also formed in the middle of the laminated body A, as shown in FIG. 2(*a*), thus the outer surface of the thin-walled container 1 appears through the window. Thus, it is very fun and interesting to see the development process of the tunnel-like structures and the window.

A color, letter, character, or the like can be painted on the outer surface of the thin-walled container 1 where the window 13 is to be developed. By doing that, the color, letter, character, or the like which is hidden behind the laminated body will appear when the tunnel-like structure is formed. Thus, since the change is more clearly seen, the container becomes more visually appealing. In this embodiment, the laminated body has two adhesive portions. Therefore, when a part of the adhesive portions is defective, it can prevent the laminated body from peeling off the trunk portion of the thin-walled container 1.

The base material can be made of any material, as far as it conforms to the object of the present invention. In this embodiment, the distance of an uncut portion between the upper end of the laminated body and the upper end of the cut line 2 and the distance of an uncut portion between the bottom end of the laminated body and the bottom end of the cut line 2 are about 3 millimeters. However, those distances are not limited, as far as there is no functional problem. Likewise, although the cut lines 3 are provided vertically to both ends of the cut line 2, they can cross the end portion of the cut line 2. Further, although there are two adhesive portions 50 and 51 provided in this embodiment, there is no problem if there is only one adhesive portion. However, it is preferable to provide two adhesive portions from the viewpoint of clearly forming the window 13.

Furthermore, the cut line 2 can not only be a straight line, but can also be a meander line or a zigzag line.

In the above embodiment, bonded portions 5, 6, 7, and 8 of two base materials are different in width from the bonded portions 9 and 10, as shown in FIG. 1(*b*). However, the widths of the bonded portions may vary depending on the purpose of use. Preferably, the width of the bonded portion 4 should be set to a sufficient width in consideration of dimensional deviation which occurs when the cut lines are made. In this embodiment, the bonded portion 4 has a relatively wide width of about 3 mm.

FIG. 2(*b*) shows another embodiment of the present invention, in which strip-like bonded portions of the laminated body A spaced apart from each other are fixed to the thin-walled container 1 in such a manner that they cross the generatrix of the container 1 diagonally. Other conditions of the container are the same as those in the above-described embodiment. In this embodiment, since the tunnel-like structures are also formed in such a manner that they diagonally cross the generatrix of the container 1, which is effective to create structural variations and to prevent the container from slipping off the hand.

Figure 3A:
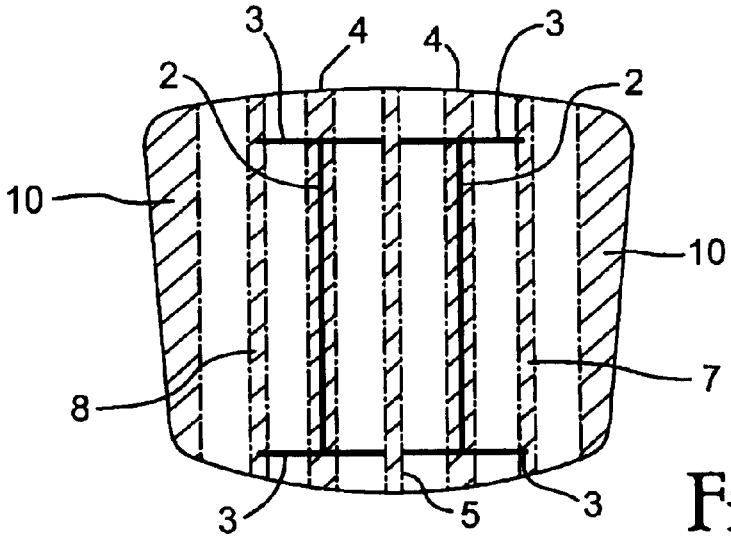
FIG. 3 is a plan view of another embodiment of the laminated body.
Figure 3B:
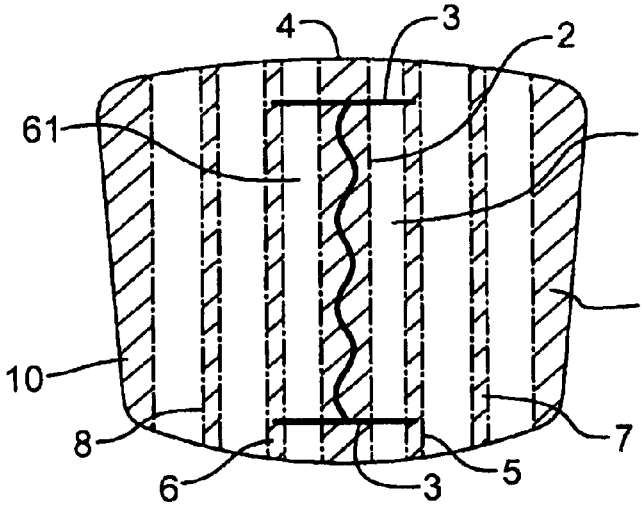
Figure 3C:
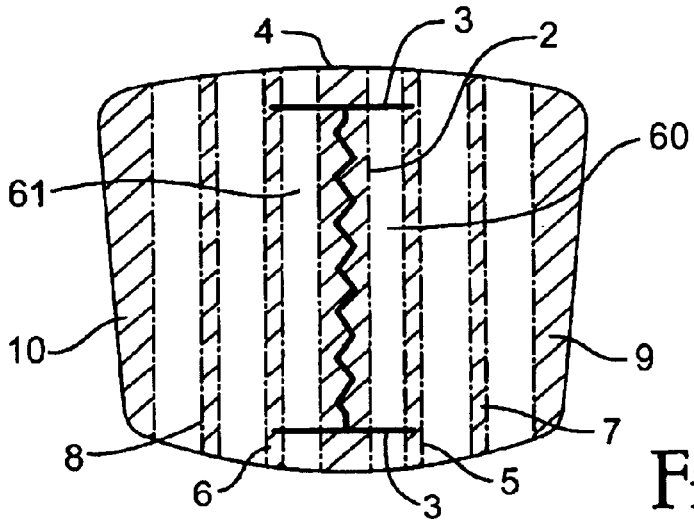
Figure 4A:
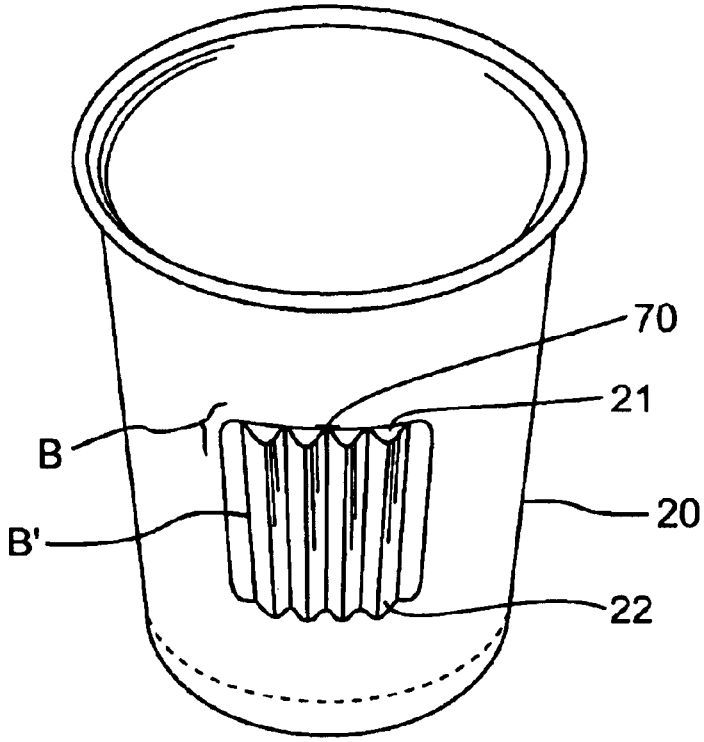
FIG. 4(*a*) is a perspective view of a conventional container, showing the state of the container after the application of heat.
Figure 4B:
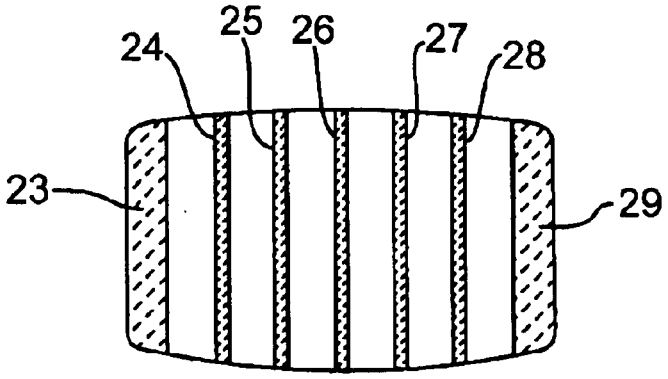

FIG. 3(*a*) shows still another embodiment of the present invention, in which a plurality of I-shaped cut lines are provided to the plurality of bonded portions of the laminated body. Such container makes it possible to enjoy a great variety of the shape of the tunnel-like structure. In this embodiment, from the viewpoint of forming equal-sized windows, the laminated body is preferably adhered to the thin-walled container 1 at three adhesive portions which is provided to the back of the narrow bonded portions 5, 7, and 8. Other conditions and effects are the same as those in the above-described embodiment. The laminated bodies can be shaped like a tube which fits over the thin-walled container 1 and to which a plurality of I-shaped cut lines 2 and 3 are provided in the same manner as the above embodiment so as to provide insulating portion all around the container.

In the above embodiments, the truncated cone-shaped container is used. However, the container shaped like a circular cylinder or other variations can also be used to yield the same effect.

INDUSTRIAL APPLICABILITY

Since the insulated container of the present invention is structured as described above, we can enjoy various changes in the shape of the laminated body, and the container is more aesthetically attractive and appealing and can be manufactured at a low cost.

There has thus been shown and described a novel insulated container which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A container that comprises a thin-walled container having an outer surface and a laminated body attached to said outer surface, said laminated body comprising at least two base materials wherein one base material has a higher heat shrinkage percentage than the other, said base materials being bonded to each other at bonded portions spaced apart from each other, said laminated body being attached to the thin-walled container such that said base material having the higher heat shrinkage percentage is inwardly disposed towards said outer surface, said laminated body having at least one set of cut lines, each said set of cut lines including upper and lower spaced apart and substantially horizontal cut lines connected by a substantially vertical cut line that extends therebetween, so that said laminated body is cut at one of the bonded portions into left and right sections along said substantially vertical line, whereby when said thin-walled container is filled with a hot material the base material having a higher heat shrinkage is thermally shrunk and the laminated body partitions along said substantially vertical cut line.

2. The container according to claim 1, wherein said laminated body is attached to the outer surface of the thin-walled container by a plurality of strip-shaped adhesive portions; said adhesive portions extending from top to bottom of the laminated body.

3. The container according to claim 2, wherein said adhesive portions are provided on portions of said laminated body except said at least one substantially vertical cut line.

4. The container according to claim 2, wherein said adhesive portions are positioned such that said at least one substantially vertical cut line is spaced between adjacent adhesive portions.

5. The container according to claim 1, wherein said base material having the higher heat shrinkage percentage is a uniaxially oriented film, and the other base material is paper.

6. The container according to claim 1, wherein said at least one substantially vertical cut line is a straight line, line meandering in one direction, or a line zigzagging in one direction.

7. The container according to claim 2, wherein said adhesive portions are provided in such a manner that they diagonally cross a generatrix of the container.

* * * * *